US007690482B2

(12) United States Patent
Shoulders

(10) Patent No.: US 7,690,482 B2
(45) Date of Patent: Apr. 6, 2010

(54) SCREW COMPRESSOR LUBRICATION

(75) Inventor: Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 131 days.

(21) Appl. No.: 11/813,770

(22) PCT Filed: Feb. 7, 2005

(86) PCT No.: PCT/US2005/003816

§ 371 (c)(1),
(2), (4) Date: Jul. 12, 2007

(87) PCT Pub. No.: WO2006/085865

PCT Pub. Date: Aug. 17, 2006

(65) Prior Publication Data

US 2008/0131301 A1 Jun. 5, 2008

(51) Int. Cl.
*F01M 1/00* (2006.01)

(52) U.S. Cl. ..... 184/6.16; 418/97; 60/39.08

(58) Field of Classification Search ..... 184/6.16; 418/97, 201, 100; 60/39.08
See application file for complete search history.

(56) References Cited

U.S. PATENT DOCUMENTS 4,080,119 A * 3/1978 Eriksson ..... 418/97
4,762,477 A * 8/1988 Hayano et al. ..... 418/1
5,201,648 A 4/1993 Lakowske
5,605,124 A * 2/1997 Morgan ..... 123/222
5,674,063 A * 10/1997 Ozaki et al. ..... 418/201.3
5,795,136 A 8/1998 Olsaker et al.
6,394,777 B2 * 5/2002 Haavik ..... 418/85
6,422,844 B2 7/2002 Hioki et al.
6,866,490 B2 3/2005 Daniels et al.
7,347,301 B2 3/2008 Sekiya et al.
7,553,142 B2 6/2009 Zinsmeyer et al.
2008/0138230 A1 * 6/2008 Notis ..... 418/194

FOREIGN PATENT DOCUMENTS

GB 1370100 10/1974
TW 382044 A 2/2002
TW 530887 A 5/2003

OTHER PUBLICATIONS

Chinese Office Action for CN200580047539.1, dated Feb. 6, 2009.
Chinese Office Action for CN200580047539.1, dated Feb. 6, 2009.

* cited by examiner

*Primary Examiner*—David M Fenstermacher
(74) *Attorney, Agent, or Firm*—Bachman & LaPointe, P.C.

(57) ABSTRACT

A screw compressor (20) has a housing having first and second ports along a flow path. A male-lobed rotor has a first rotational axis. A female-lobed rotor has a second rotational axis and is enmeshed with the male-lobed rotor to define a compression path between suction and discharge locations along the flow path. The compressor has a compressor lubrication network having a lubricant outlet port (242) along a low pressure cusp (244). An unloading slide valve element (102) may be along a high pressure cusp (105).

16 Claims, 3 Drawing Sheets

SCREW COMPRESSOR LUBRICATION

BACKGROUND OF THE INVENTION

The invention relates to compressors. More particularly, the invention-relates to refrigerant compressors.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

It is often desirable to temporarily reduce the refrigerant mass flow through the compressor by delaying the closing off of the inlet port (with or without a reduction in the compressor volume index) when full capacity operation is not required. Such unloading is often provided by a slide valve having a valve element with one or more portions whose positions (as the valve is translated) control the respective suction side closing and discharge side opening of the compression pockets. The primary effect of an unloading shift of the slide valve is to reduce the initial trapped suction volume (and hence compressor capacity); a reduction in volume index is a typical side effect. Exemplary slide valves are disclosed in U.S. Patent Application Publication No. 20040109782 A1 and U.S. Pat. Nos. 4,249,866 and 6,302,668.

Compressor lubrication is important. Lubricant (e.g., oil) entrained in the refrigerant flow may help lubricate the rotor lobes. Such oil may be introduced in the suction plenum or may already be contained in the inlet refrigerant flow. Additional lubrication may be required for the bearing systems. Accordingly, oil flows may be introduced to the bearing compartments (e.g., from an oil supply provided by a separator downstream of the compressor discharge). It is often desired to provide yet further lubrication of the rotor lobes. Various systems have included the introduction of oil through the unloading slide valve element. Additionally, oil has been introduced through the rotors themselves (e.g., from an inlet at an end of one of the rotors to one or more outlets along the lobed body of that rotor).

SUMMARY OF THE INVENTION

According to one aspect of the invention, a screw compressor has compressor lubrication network having a lubricant outlet port along a low pressure cusp.

In various implementations, an unloading slide valve element may be along a high pressure cusp. The network may include a an axial feed passageway and a branch to the outlet and additional branches to bearing compartments. The network may include a metering orifice in the branch. The outlet port may be provided in a remanufacturing of a compressor or the reengineering of a compressor configuration from an initial baseline configuration.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
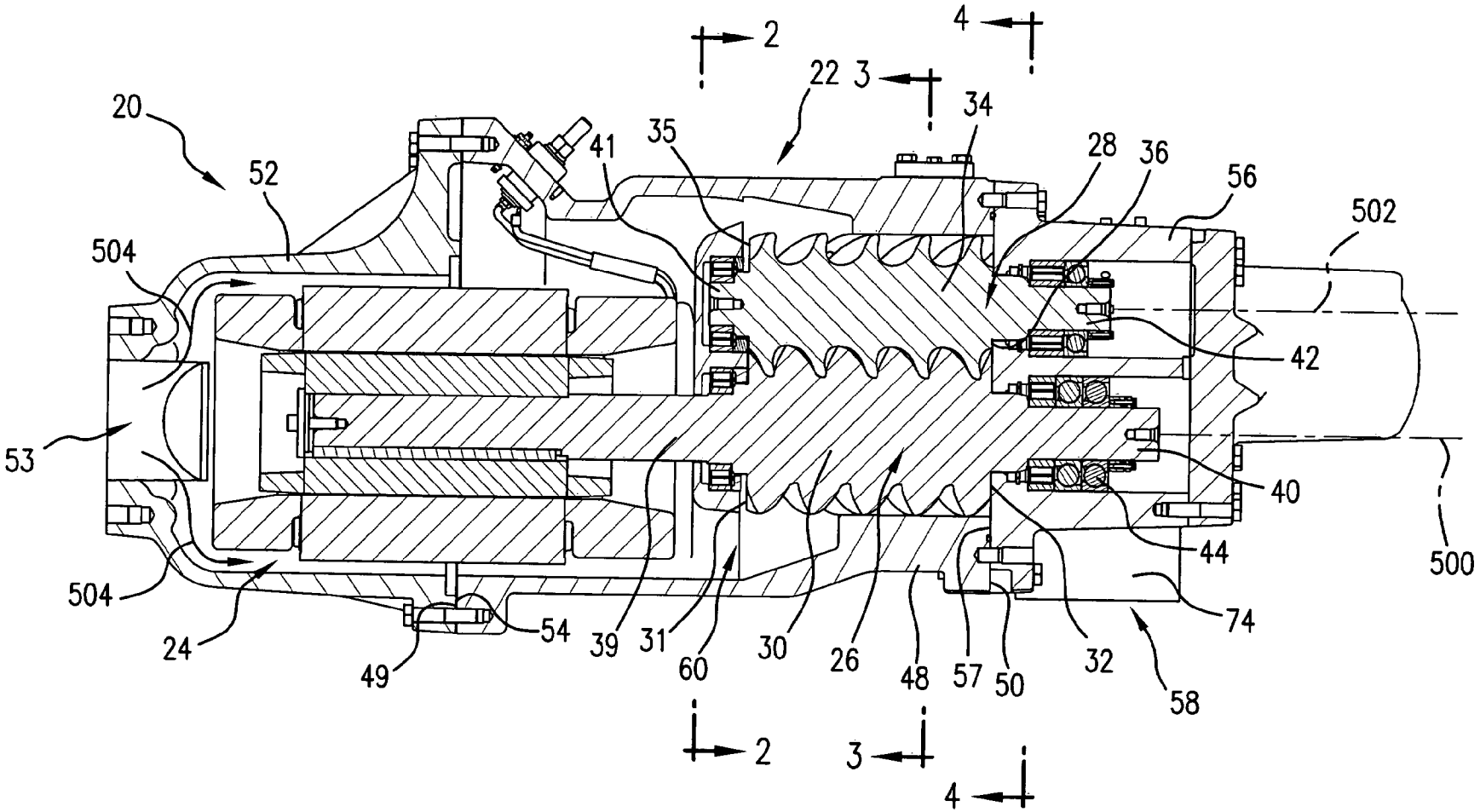
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet/discharge housing 56 having an upstream face 57 mounted to the rotor housing downstream face and having an outlet/discharge port 58. The exemplary rotor housing, motor/inlet housing, and outlet housing 56 may each be formed as castings subject to further finish machining.

Figure 5:
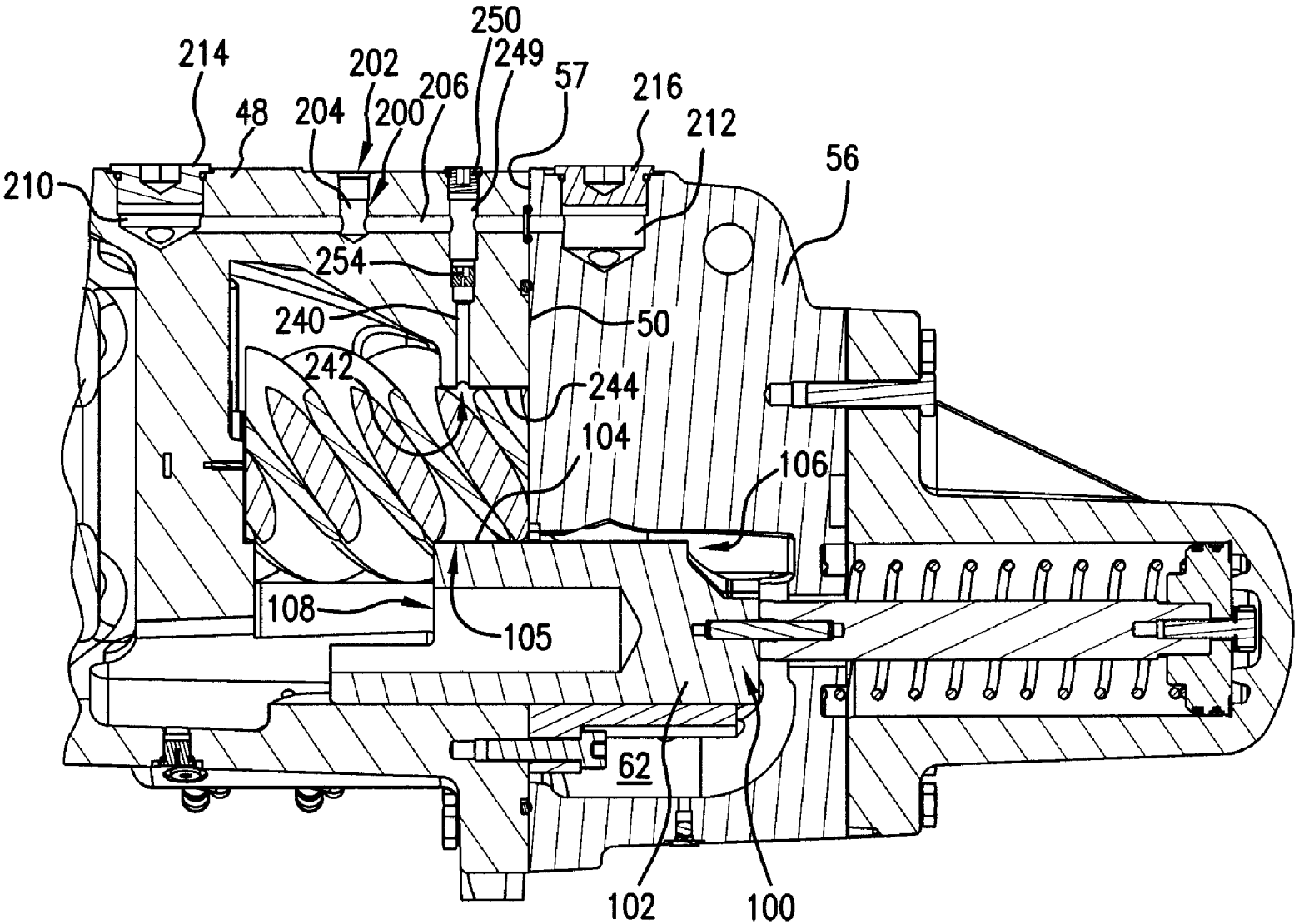
FIG. 5 is a partial longitudinal sectional view of the compressor of FIG. 1, taken along line 5-5 of FIG. 4.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62 (FIG. 5). A series of pairs of male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

For capacity control/unloading, the compressor has a slide valve 100 (FIG. 5) having a valve element 102. The valve element 102 has a portion 104 along the mesh zone between the rotors (i.e., along the high pressure cusp 105). The exemplary valve element has a first portion 106 at the discharge plenum and a second portion 108 at the suction plenum. The valve element is shiftable to control compressor capacity to provide unloading. The exemplary valve is shifted via linear translation parallel to the rotor axes between fully loaded and fully unloaded positions/conditions.

FIG. 5 further shows details of a compressor lubrication system for lubricating the bearings and the rotor bodies. The exemplary lubrication system includes an oil conduit network 200 extending from an inlet 202 in an exterior of the rotor housing/case 48. The network includes an inlet bore 204 extending from the inlet port 202 to an axial passageway 206. The exemplary axial passageway includes portions within both the rotor case 48 and the discharge housing/case 56. This permits easy drilling of these portions respectively from the faces 50 and 57.

Figure 2:
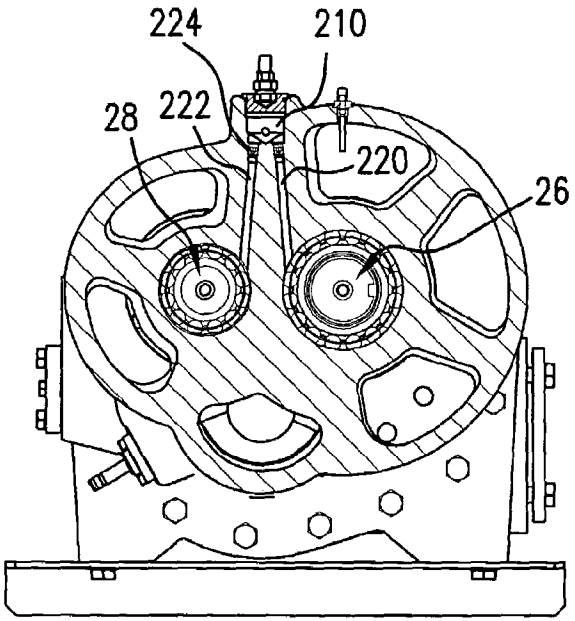
FIG. 2 is a transverse sectional view of the compressor of FIG. 1, taken along line 2-2.

At respective suction and discharge ends of the axial passageway 206 (FIG. 5), the rotor case 48 and discharge case 56 respectively include plenum bores 210 and 212 whose outer (proximal) ends are sealed by plugs 214 and 216, respectively. Extending from each of the plenum bores are a pair of branch passageways for directing oil to the associated bearing systems. FIG. 2 shows branch passageways 220 and 222 respectively extending to the suction end bearing compartments of the rotors 26 and 28. At proximal ends of the branches 220 and 222, each branch includes a metering orifice 224. In the exemplary embodiment, to reach the associated bearing compartments the branches 220 and 222 are slightly distally, divergent from each other and from the axis of their common plenum bore 210. The relatively greater breadth of the plenum bore 210 facilitates the drilling of these branches slightly off parallel to the plenum bore.

Figure 4:
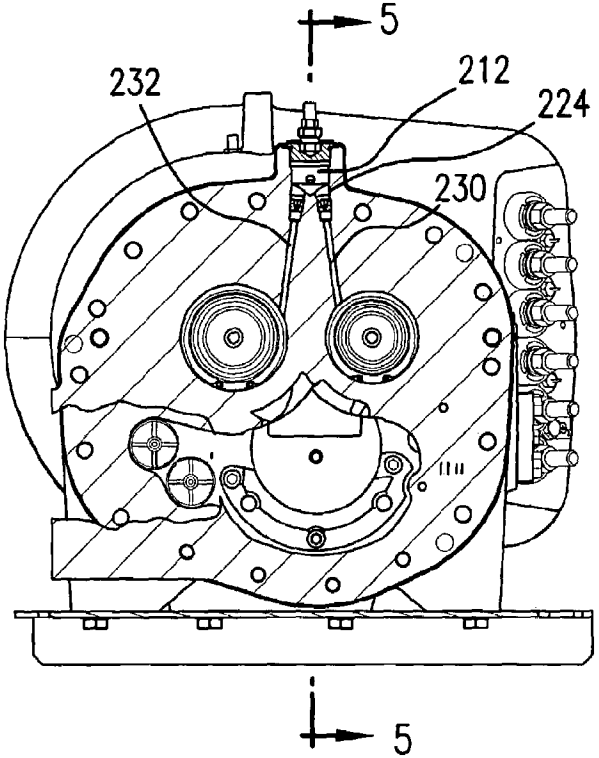
FIG. 4 is a partially cutaway transverse sectional view of the compressor of FIG. 1, taken along line 4-4.
Figure 3:
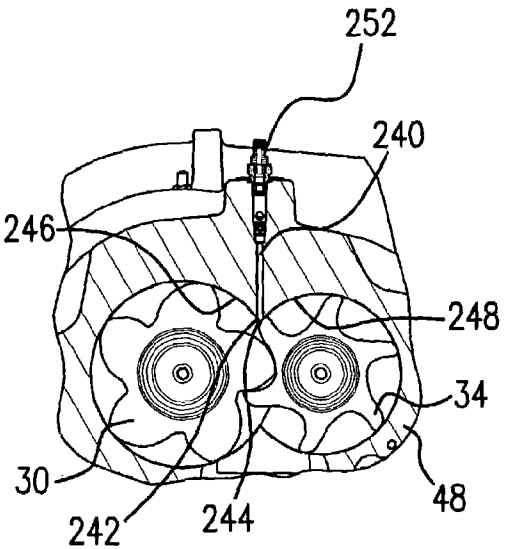
FIG. 3 is a partial transverse sectional view of the compressor of FIG. 1, taken along line 3-3.

FIG. 4 shows similar branches 230 and 232 extending from the plenum bore 212 for lubricating the discharge end bearing systems. As so far described, the compressor may be of a pre-existing baseline configuration. According to the present invention, additional lubrication is provided by means of a passageway branch 240 having an outlet 242 proximate a low pressure cusp 244. FIG. 3 shows the cusp 244 at the junction of the bore surfaces 246 and 248 in the rotor case 48 accommodating the rotor working portions 30 and 34. In the exemplary embodiment, the outlet is exactly along the cusp. Alternatives may involve slight shifts (e.g., toward peaks of the bores). For example, with the exemplary baseline compressor, the outlet would still be opposite the slide valve (above in the exemplary orientation wherein the slide valve is below).

Returning to FIG. 5, the branch 240 is formed as a portion of a stepped bore 249 intersecting the axial passageway 206. A proximal portion of the stepped bore at the exterior of the rotor housing 48 may contain a plug 250. An exemplary plug may include a pressure sensor 252 (FIG. 3). In an intermediate location, the passageway 240 contains a metering orifice 254. The metering orifice meters the flow of oil through the outlet 242, permitting a desired flow of oil droplets to exit the outlet and fall onto the enmeshed rotor lobes.

The exemplary positioning of the outlet 242 is such that it is exposed to suction conditions. This may be distinguished from other lubrication systems that introduce oil only to a closed compression pocket. However, the outlet 242 may be positioned so that the compression pocket closes on the introduced oil very shortly after introduction (e.g., oil dropped onto the surface of a rotor lobe tends to move with the lobe and the compression pocket may close on that location along the lobe very shortly thereafter). This proximity may help avoid any deleterious effects of longer-term exposure of the oil to suction conditions.

The branch 240 may be added to a compressor in a remanufacturing or added to a compressor configuration in a redesign/reengineering. Other features of the baseline compressor's lubrication system may be preserved or may be modified. For example, a pre-existing axial passageway could be tapped into.

One or more embodiments of the present invention have been described. Nevertheless, it will be understood that various modifications may be made without departing from the spirit and scope of the invention. For example, when implemented as a remanufacturing or reengineering, details of the baseline compressor may influence or dictate details of any particular implementation. Accordingly, other embodiments are within the scope of the following claims.

What is claimed is:

1. A compressor apparatus (20) comprising:

a housing (22) having first (53) and second (58) ports along a flow path;

a male-lobed rotor (26) having a first rotational axis (500); and a female-lobed rotor (28) having a second rotational axis (502) and enmeshed with the male-lobed rotor to define a compression path between suction (60) and discharge (62) locations along the flow path; and a lubrication network having:

a lubricant outlet port (242) along a low pressure cusp (244) of said male-lobed and female-lobed rotors.

2. The apparatus (20) of claim 1 wherein:

each of said male-lobed and female-lobed rotors has a suction end bearing system and a discharge end bearing system; and the lubrication network includes first (220) and second (222) branches feeding lubricant to the suction end bearing systems of the male-lobed and female-lobed rotors, respectively, and third (230) and fourth (232) branches feeding lubricant to the discharge end bearing systems of the male-lobed and female-lobed rotors, respectively.

3. The apparatus of claim 2 wherein the lubrication network further comprises:

a fifth branch (240) extending to said outlet port (242); and an axial passageway (206) coupling said first (220), second (222), third (230), fourth (232), and fifth (240) branches.

4. The apparatus of claim 3 wherein the lubrication network further comprises:

first, second, third, fourth, and fifth metering orifices (224; 254) respectively in the first, second, third, fourth, and fifth branches.

5. The apparatus of claim 1 wherein:

the outlet (242) is at an end of a bore (249) from an exterior of the housing.

6. The apparatus of claim 5 wherein:

a pressure sensor (252) is located in the bore.

7. The apparatus of claim 6 wherein:

a metering orifice (254) is located in the bore (249); and an axial feed passageway (206) intersects the bore (249) between the pressure sensor (252) and the metering orifice (254).

8. The apparatus of claim 1 wherein:

the lubricant consists essentially of oil.

9. The apparatus of claim 8 wherein:

the bore (249) extends downward toward the outlet (242) so as to permit drops of said oil to fall onto one or both of the male-lobed and female-lobed rotors.

10. The apparatus of claim 1 wherein:

the outlet is positioned so as to be exposed to suction conditions.

11. The apparatus of claim 1 further comprising:

an unloading slide valve (100) having:

a valve element (102) along a high pressure cusp (105) of said male-lobed and female-lobed rotors and having a range between a first condition and a second condition, the second condition being unloaded relative to the first condition.

12. The apparatus of claim 11 wherein the slide valve (100) further comprises:

a cylinder (128); and a piston (124) in the cylinder and mechanically coupled to the valve element.

13. A method for lubricating a screw compressor comprising:

introducing a lubricant flow through a lubricant port in a compressor housing; and directing at least a portion of the lubricant to a lubricant outlet proximate a low pressure cusp of the compressor.

14. A method for remanufacturing a compressor or reengineering a configuration of the compressor comprising:

providing an initial such compressor or configuration having:

a housing; and one or more working elements cooperating with the housing to define a compression path between suction and discharge locations; and adapting such compressor or configuration to include means for introducing lubricant proximate a low pressure cusp of the compressor.

15. The method of claim 14 wherein:

the baseline compressor or configuration includes:

an unloading slide valve having:

a valve element along a high pressure cusp and having a range between a first condition and a second condition, the second condition being unloaded relative to the first condition.

16. The method of claim 14 wherein:

in the initial compressor or configuration:

each of male-lobed and female-lobed rotors has suction end bearing system and a discharge end bearing system; and a lubrication network includes first and second branches feeding lubricant to the suction end bearing systems of the male-lobed and female-lobed rotors, respectively, and third and fourth branches feeding lubricant to the discharge end bearing systems of the male-lobed and female-lobed rotors, respectively; and the adapting includes adding a fifth branch extending to the outlet.

* * * * *